US005895828A

United States Patent [19]

Yao et al.

[11] Patent Number: 5,895,828

[45] Date of Patent: Apr. 20, 1999

[54] HYDROCARBON CONVERSION CATALYST COMPOSITION AND PROCESSES THEREFOR AND THEREWITH

[75] Inventors: Jianhua Yao, Bartlesville; Charles A. Drake, Nowata, both of Okla.

[73] Assignee: Phillips Petroleum Company, Bartlesville, Okla.

[21] Appl. No.: 08/868,968

[22] Filed: Jun. 4, 1997

[51] Int. Cl.[6] ..... C07C 2/52; C07C 15/00; C10G 35/06

[52] U.S. Cl. ..... 585/418; 585/407; 208/135; 208/137

[58] Field of Search ..... 585/405, 407, 585/411, 418, 435, 438, 439, 444, 483, 486–489, 648; 208/134, 135, 137

[56] References Cited

U.S. PATENT DOCUMENTS

| | | | |
|---|---|---|---|
| 3,864,284 | 2/1975 | Clippinger et al. | 252/466 PT |
| 3,972,832 | 8/1976 | Butler et al. | 252/437 |
| 4,251,676 | 2/1981 | Wu | 585/486 |
| 4,304,657 | 12/1981 | Miller | 208/135 |
| 4,477,585 | 10/1984 | Kaeding | 502/77 |
| 4,654,457 | 3/1987 | Sato et al. | 585/468 |
| 4,879,424 | 11/1989 | Harandi | 585/322 |
| 4,935,566 | 6/1990 | Dessau et al. | 208/65 |
| 4,950,823 | 8/1990 | Harandi et al. | 585/322 |
| 4,975,402 | 12/1990 | Le Van Mao et al. | 502/69 |
| 5,574,199 | 11/1996 | Beck et al. | 585/407 |

OTHER PUBLICATIONS

Hackh's Chemical Dictionary, 4th edition, 1969, p. 444.

CA 90:137361w (1979), 25–Noncondensed Aromatics, vol. 90, p. 473.

CA 94:29573r (1981), 21–General Org. Chem., vol. 94, p. 475.

*Primary Examiner*—Glenn A. Caldarola
*Assistant Examiner*—Thuan D. Dang
*Attorney, Agent, or Firm*—Lucas K. Shay

[57] ABSTRACT

A catalyst composition and a process for converting a hydrocarbon stream such as, for example, gasoline to olefins and $C_6$ to $C_8$ aromatic hydrocarbons such as toluene and xylenes are disclosed. The catalyst composition comprises a zeolite, and optionally an activity promoter in the range of from about 0.01 to about 10 weight %. The process comprises contacting a hydrocarbon stream with the catalyst composition under a condition sufficient to effect the conversion of a hydrocarbon to an olefin and a $C_6$ to $C_8$ aromatic hydrocarbon. Also disclosed is a process for producing the catalyst composition.

17 Claims, No Drawings

HYDROCARBON CONVERSION CATALYST COMPOSITION AND PROCESSES THEREFOR AND THEREWITH

FIELD OF THE INVENTION

This invention relates to a composition useful for converting a hydrocarbon to a $C_6$ to $C_8$ aromatic hydrocarbon and an olefin, to a process for producing the composition, and to a process for using the composition for converting a hydrocarbon to a $C_6$ to $C_8$ aromatic hydrocarbon and an olefin.

BACKGROUND OF THE INVENTION

It is well known to those skilled in the art that aromatic hydrocarbons and olefins are each a class of very important industrial chemicals which find a variety of uses in petrochemical industry. It is also well known to those skilled in the art that catalytically cracking gasoline-range hydrocarbons produces lower olefins such as, for example, propylene; and aromatic hydrocarbons such as, for example, benzene, toluene, and xylenes (hereinafter collectively referred to as BTX) in the presence of catalysts which contain a zeolite. The product of this catalytic cracking process contains a multitude of hydrocarbons including unconverted $C_5$+ alkanes; lower alkanes such as methane, ethane, and propane; lower alkenes such as ethylene and propylene; and $C_9$+ aromatic compounds which contain 9 or more carbons per molecule. Recent efforts to convert gasoline to more valuable petrochemical products have therefore focused on improving the conversion of gasoline to olefins and aromatic hydrocarbons by catalytic cracking in the presence of zeolite catalysts. For example, a gallium-promoted zeolite ZSM-5 has been used in the so-called Cyclar Process to convert a hydrocarbon to BTX. The olefins and aromatic hydrocarbons can be useful feedstocks for producing various organic compounds and polymers. However, the weight ratio of olefins to aromatic compounds produced by the conversion process is generally less than 50%. Therefore, development of a catalyst and a process for converting hydrocarbons to the more valuable olefins and BTX would be a significant contribution to the art and to the economy.

SUMMARY OF THE INVENTION

An object of this invention is to provide a catalyst composition which can be used to convert a hydrocarbon to a $C_6$ to $C_8$ aromatic hydrocarbon and an olefin. Also an object of this invention is to provide a process for producing the catalyst composition. Another object of this invention is to provide a process which can employ the catalyst composition to convert a hydrocarbon to an olefin and a $C_6$ to $C_8$ aromatic hydrocarbon. An advantage of the catalyst composition is that it enhances the ratio of produced olefins to BTX. Other objects and advantages will becomes more apparent as this invention is more fully disclosed hereinbelow.

According to a first embodiment of the present invention, a composition which can be used as a catalyst for converting a hydrocarbon or a hydrocarbon mixture to an olefin and a $C_6$ to $C_8$ aromatic hydrocarbon is provided. The composition comprises a zeolite and optionally an activity promoter wherein the promoter is present in the composition in the range of from about 0.01 to about 10 weight percent (%).

According to a second embodiment of the present invention, a process which can be used for producing a catalyst composition is provided. The process comprises the steps of: (1) combining a zeolite with an activity promoter under a condition effective to produce a promoted zeolite; and (2) calcining the promoted zeolite.

According to a third embodiment of the present invention, a process which can be used for converting a hydrocarbon or a hydrocarbon mixture to an olefin and a $C_6$ to $C_8$ aromatic hydrocarbon is provided which comprises, consists essentially of, or consists of, contacting a fluid which comprises a hydrocarbon, or a hydrocarbon mixture, and a diluent with a catalyst composition, which can be the same as disclosed above in the first embodiment of the invention, under a condition effective to convert a hydrocarbon to an olefin and an aromatic hydrocarbon containing 6 to 8 carbon atoms per molecule wherein the weight ratio of the olefin to aromatic compound is enhanced.

DETAILED DESCRIPTION OF THE INVENTION

The catalyst composition of the first embodiment of the present invention can comprise, consist essentially of, or consist of a zeolite and optionally an activity promoter. The promoter is preferably impregnated or coated on the zeolite. According to the present invention the weight of the promoter in the invention composition can be in the range of from about 0.01 to about 10, preferably about 0.05 to about 8, and most preferably 0.1 to 5 grams per 100 grams of the composition. The composition can also comprise a binder. The weight of the binder generally can be in the range of from about 1 to about 50, preferably about 5 to about 40, and most preferably 5 to 35 grams per 100 grams of the composition. Zeolite generally makes up the rest of the composition. The composition can further be characterized by having the following physical characteristics: a surface area as determined by the BET method using nitrogen in the range of from about 300 to about 600, preferably 350 to 500 $m^2/g$; a pore volume in the range of from about 0.4 to about 0.8, preferably about 0.5 to about 0.75, and most preferably 0.6 to 0.75 ml/g; an average pore diameter in the range of from about 70 to about 300, preferably about 100 to about 250, and most preferably 125 to 200 Å; and a porosity of more than about 50%.

Any commercially available zeolite which can catalyze the conversion of a hydrocarbon to an aromatic compound and an olefin can be employed in the present invention. Examples of suitable zeolites include, but are not limited to, those disclosed in Kirk-Othmer Encyclopedia of Chemical Technology, third edition, volume 15 (John Wiley & Sons, New York, 1991) and in W. M. Meier and D. H. Olson, "Atlas of Zeolite Structure Types," pages 138–139 (Butterworth-Heineman, Boston, Mass., 3rd ed. 1992). The presently preferred zeolites are those having medium pore sizes and having the physical characteristics disclosed above. ZSM-5 and similar zeolites that have been identified as having a framework topology identified as MFI are particularly preferred because of their shape selectivity.

Any promoter that can enhance the production of olefins in an aromatization process which converts a hydrocarbon or a mixture of hydrocarbons into aromatic hydrocarbons can be used. Examples of such promoters include, but are not limited to, sulfur, phosphorus, silicon, boron, tin, zinc, titanium, zirconium, molybdenum, lanthanum, cesium, an oxide thereof, and combinations of two or more thereof.

Any binders known to one skilled in the art for use with a zeolite are suitable for use herein. Examples of suitable binders include, but are not limited to, clays such as for example, kaolinite, halloysite, vermiculite, chlorite, attapulgite, smectite, montmorillonite, illite, saconite, sepiolite, palygorskite, diatomaceous earth, and combinations of any two or more thereof; aluminas such as for example α-alumina and γ-alumina; silicas; alumina-silica; aluminum phosphate; aluminum chlorohydrate; and combinations of two or more thereof. Because these binders are well known to one skilled in the art, description of which is omitted herein. The presently preferred binder, if employed, is alumina because it is readily available.

The composition of the present invention can be prepared by combining a zeolite, optionally a binder and a promoter in the weight percent disclosed above under any conditions sufficient to effect the production of such a composition.

However, it is presently preferred that the composition of the present invention be produced by the process disclosed in the second embodiment of the invention. First, a zeolite can be optionally combined with a binder disclosed above under a condition sufficient to produce a zeolite-binder mixture.

According to the present invention, a zeolite, preferably a ZSM-5 zeolite, and the binder can be well mixed by any means known to one skilled in the art such as stirring, blending, kneading, or extrusion, following which the zeolite-binder mixture can be dried in air at a temperature in the range of from about 20 to about 800° C., for about 0.5 to about 50 hours under any pressures that accommodate the temperatures, preferably under atmospheric pressure. Thereafter, the dried, zeolite-binder mixture can be further calcined, if desired, in air at a temperature in the range of from about 300 to 1000° C., preferably about 350 to about 750° C., and most preferably 450 to 650° C. for about 1 to about 30 hours to prepare a calcined zeolite-binder. Before a binder is combined with a zeolite, the zeolite can also be calcined under similar conditions to remove any contaminants, if present, to prepare a calcined zeolite.

A zeolite, whether it has been calcined or contains a binder, can also be treated with an acid. Generally, any organic acids, inorganic acids, or combinations of any two or more thereof can be used in the process of the present invention so long as the acid can reduce the aluminum content in the zeolite. The acid can also be a diluted aqueous acid solution. Examples of suitable acids include, but are not limited to sulfuric acid, hydrochloric acid, nitric acid, phosphoric acid, formic acid, acetic acid, trifluoroacetic acid, trichloroacetic acid, p-toluenesulfonic acid, methanesulfonic acid, partially or fully neutralized acids wherein one or more protons have been replaced with, for example, a metal (preferably an alkali metal) or ammonium ion, and combinations of any two or more thereof. Examples of partially neutralized acids include, but are not limited to, sodium bisulfate, sodium dihydrogen phosphate, potassium hydrogen tartarate, ammonium sulfate, ammonium chloride, ammonium nitrate, and combinations thereof. The presently preferred acids are hydrochloric acid and nitric acid for they are readily available.

Any methods known to one skilled in the art for treating a solid catalyst with an acid can be used in the acid treatment of the present invention. Generally, a zeolite material can be suspended in an acid solution. The concentration of the zeolite in the acid solution can be in the range of from about 0.01 to about 500, preferably about 0.1 to about 400, more preferably about 1 to about 350, and most preferably 5 to 300 grams per liter. The amount of acid required is the amount that can maintain the solution in acidic pH during the treatment. Preferably the initial pH of the acid solution containing a zeolite is adjusted to lower than about 6, preferably lower than about 5, more preferably lower than about 4, and most preferably lower than 3. Upon the pH adjustment of the solution, the solution can be subjected to a treatment at a temperature in the range of from about 30° C. to about 200° C., preferably about 50° C. to about 150° C., and most preferably 70° C. to 120° C. for about 10 minutes to about 30 hours, preferably about 20 minutes to about 25 hours, and most preferably 30 minutes to 20 hours. The treatment can be carried out under a pressure in the range of from about 1 to about 10 atmospheres (atm), preferably about 1 atm so long as the desired temperature can be maintained. Thereafter, the acid-treated zeolite material can be washed with running water for 1 to about 60 minutes followed by drying, at about 50 to about 1000, preferably about 75 to about 750, and most preferably 100 to 650° C. for about 0.5 to about 15, preferably about 1 to about 12, and most preferably 1 to 10 hours, to produce an acid-leached zeolite. Any drying method known to one skilled in the art such as, for example, air drying, heat drying, spray drying, fluidized bed drying, or combinations of two or more thereof can be used.

The dried, acid-leached zeolite can also be further washed, if desired, with a mild acid solution such as, for example, ammonium nitrate which is capable of maintaining the pH of the wash solution in acidic range. The volume of the acid generally can be the same volume as that disclosed above. The mild acid treatment can also be carried out under substantially the same conditions disclosed in the acid treatment disclosed above. Thereafter, the resulting solid can be washed and dried as disclosed above.

The dried, acid-leached zeolite, whether it has been further washed with a mild acid or not, can be calcined, if desired, under a condition known to those skilled in the art. Generally such a condition can include a temperature in the range of from about 250 to about 1,000, preferably about 350 to about 750, and most preferably 450 to 650° C. and a pressure in the range of from about 0.5 to about 50, preferably about 0.5 to about 30, and most preferably 0.5 to 10 atmospheres (atm) for about 1 to about 30 hours, preferably about 2 to about 20 hours, and most preferably 3 to 15 hours.

A zeolite, a calcined zeolite, or a calcined zeolite-binder mixture, or an acid-leached zeolite, can be treated with a compound containing an exchangeable ammonium ion to prepare an ammonium-exchanged zeolite. Whether a zeolite is calcined or contains a binder, the process or treatment in the second embodiment is the same for each. For the interest of brevity, only a zeolite is described hereinbelow. Examples of suitable ammonium-containing compounds include, but are not limited to, ammonium sulfate, ammonium chloride, ammonium nitrate, ammonium bromide, ammonium fluoride, and combinations of any two or more thereof. Treatment of the zeolite replaces the original ions such as, for example, alkali or alkaline earth metal ions of the zeolite with predominantly ammonium ions. Techniques for such treatment are well known to one skilled in the art such as, for example, ion exchange of the original ions. For example, a zeolite can be contacted with a solution containing a salt of the desired replacing ion or ions.

Generally, a zeolite can be suspended in an aqueous solution of an ammonium-containing compound. The concentration of the zeolite in the aqueous solution can be in the range of from about 0.01 to about 800, preferably about 0.1 to about 500, more preferably about 1 to about 400, and most preferably 5 to 100 grams per liter. The amount of the ammonium-containing compound required depends on the amount of the original ion(s) to be exchanged. Upon the preparation of the solution, the solution can be subject to a temperature in the range of from about 30° C. to about 200° C., preferably about 40° C. to about 150° C., and most preferably 50° C. to 125° C. for about 1 to about 100 hours, preferably about 1 to about 50 hours, and most preferably 2 to 25 hours depending on desired degrees of ion exchange. The treatment can be carried out under a pressure in the range of from about 1 to about 10 atmospheres (atm), preferably about 1 atm or any pressure that can maintain the required temperature. Thereafter, the treated zeolite can be washed with running water for 1 to about 60 minutes followed by drying and calcining to produce calcined hydrogen-form zeolite. The drying and calcining processes can be carried out substantially the same as those disclosed above for the preparation of a calcined zeolite or zeolite-binder.

Generally, the ammonium-exchanged zeolite becomes hydrogen exchanged upon calcination or high temperature treatment such that a predominant proportion of its exchangeable cations are hydrogen ions. The above-described ion exchange of exchangeable ions in a zeolite is well known to one skilled in the art. See, for example, U.S. Pat. No. 5,516,956, disclosure of which is incorporated herein by reference. Because the ion exchange procedure is well known, the description of which is omitted herein for the interest of brevity.

In the second embodiment of the invention, a zeolite or a zeolite-binder mixture, which could have been acid-leached, in a desired ionic form, regardless whether calcined or not, is contacted with a promoter precursor compound, preferably in a solution or suspension, under a condition known to those skilled in the art to incorporate a promoter precursor compound into a zeolite. Preferably the promoter precursor compound is impregnated onto the zeolite or zeolite-binder mixture. Because the methods for incorporating or impregnating a promoter precursor compound into a zeolite or zeolite-binder mixture such as, for example, impregnation by incipient wetness method, are well known to those skilled in the art, the description of which is also omitted herein for the interest of brevity.

According to the present invention, any promoter precursor compound, which upon being incorporated into, or impregnated or coated onto, a zeolite or zeolite-binder mixture can be converted into a promoter, as disclosed in the first embodiment of this invention, upon calcining can be used in the present invention. Presently it is preferred that a promoter precursor be selected from the group consisting of sulfur-containing compounds, phosphorus-containing compounds, boron-containing compounds, magnesium-containing compounds, tin-containing compounds, titanium-containing compounds, zirconium-containing compounds, molybdenum-containing compounds, germanium-containing compounds, indium-containing compounds, lanthanum-containing compounds, cesium-containing compounds, and combinations of two or more thereof.

Generally any silicon-containing compounds which can be converted to a silicon oxide that are effective to enhance the ratio olefins to BTX in the product stream in the conversion of a hydrocarbon using a zeolite can be used in the present invention. Examples of suitable silicon-containing compounds can have a formula of $(R)(R)(R)Si—(O_mSi(R)(R))_nR$ wherein each R can be the same or different and is independently selected from the group consisting of alkyl radicals, alkenyl radicals, aryl radicals, alkaryl radicals, aralkyl radicals, and combinations of any two or more thereof; m is 0 or 1; and n is 1 to about 10 wherein each radical can contain 1 to about 15, preferably 1 to about 10 carbon atoms per radical. Specific examples of such polymers include, but are not limited to, silicon-containing polymers such as poly(phenylmethyl)siloxane, poly(phenylethylsiloxane), poly(phenylpropylsiloxane), hexamethyldisiloxane, decamethyltetrasiloxane, diphenyltetramethyldisiloxane, and combinations of two or more thereof. Other silicon-containing compounds include organosilicates such as, for example, tetraethyl orthosilicate, tetrabutyl orthosilicate, tetrapropyl orthosilicate, or combination of two or more thereof. A number of well known silylating agents such as trimethylchlorosilane, chloromethyldimethylchlorosilane, N-trimethylsilylimidazole, N,O-bis(trimethylsilyl) acetimide, N-methyl-N-trimethylsilyltrifluoroacetamie, t-butyldimethylsilylimidazole, N-trimethylsilylacetamide, methyltrimethoxysilane, vinyltriethoxysilane, ethyltrimethoxysilane, propyltrimethoxysilane, (3,3,3-trifluoropropyl)trimethoxysilane, [3-(2-aminoethyl) aminopropyl]trimethoxysilane, cyanoethyltrimethoxysilane, aminopropyltriethoxysilane, phenyltrimethoxysilen, (3-chloropropyl)trimethoxysilane, (3-mercaptopropyl) trimethoxysilane, (3-glycidoxypropyl)trimethoxysilane, vinyltris(β-methoxyethoxy)silane, (γ-methacryloxypropyl) trimethoxysilane, vinylbenzyl cationic silane, (4-aminopropyl)triethoxysilane, [γ-(β-aminoethylamino) propyl]trimethoxysilane, (γ-glycidoxypropyl) trimethoxysilane, [β-(3,4-epoxycyclohexyl)ethyl] trimethoxysilane, (β-mercaptoethyl)trimethoxysilane, (γ-chloropropyl)trimethoxysilane, and combinations of two or more thereof can also be employed. The presently preferred silicon-containing compounds are tetraethyl orthosilicate and poly(phenylmethyl) siloxane.

Similarly, any phosphorus-containing compounds that, when impregnated onto or incorporated into a zeolite can be converted into a phosphorus oxide can be used in the present invention. Examples of suitable phosphorus-containing compounds include, but are not limited to, phosphorus pentoxide, phosphorus oxychloride, phosphoric acid, organic phosphates, phosphines having the formula of $P(OR)_3$, $P(O)(OR)_3$, $P(O)(R)(R)(R)$, $P(R)(R)(R)$, and combinations of two or more thereof wherein R is the same as that disclosed above. Examples of suitable organic phosphates include, but are not limited to, trimethylphosphate, triethylphosphate, tripropylphosphate, and combination of two or more thereof. The presently preferred organic phosphates are trimethylphosphate and triethylphosphate for they are readily available.

According to the present invention, any sulfur-containing compound that can be converted to a sulfur oxide upon calcining can be employed in the present invention. Example of suitable sulfur containing compounds include, but are not limited to, $(RSH)_n$, $RS_nR$, $RS(O)R$, $RS(O)(O)R$, $M_zS$, $SX_z$, $SO_zX_z$, $CO_mS_z$, $M_zH_mSO_4$, or combinations of two or more thereof wherein each R, m, and n are the same as those disclosed above, z is a number that fills the proper valency of M or X in which M is an alkali metal ion, an alkaline earth metal ion, an ammonium ion, or H, and X is a halogen or hydrogen. Specific examples of sulfur-containing compounds include, but are not limited to, ammonium sulfide, sodium sulfide, ammonium hydrogen sulfate, sodium hydrogen sulfide, potassium hydrogen sulfide, dimethyl disulfide, methyl mercaptan, diethyl disulfide, dibutyl trisulfide, sulfuryl chloride, sulfur monochloride, dinonyl tetrasulfide, hydrogen sulfide, carbon disulfide, carbonyl sulfide, sulfonyl chloride, or combinations of two or more thereof.

Examples of suitable magnesium-containing compounds include, but are not limited to, magnesium formate, magnesium acetate, magnesium bromide, magnesium bromide diethyl etherate, magnesium chloride, magnesium fluoride, magnesium nitrate, magnesium sulfate, dibutyl magnesium, magnesium methoxide, and combinations of two or more thereof.

Similarly, examples of suitable tin-containing compound include, but are not limited to, stannous acetate, stannic acetate, stannous bromide, stannic bromide, stannous chloride, stannic chloride, stannous oxalate, stannous sulfate, stannic sulfate, stannous sulfide, and combinations of two or more thereof.

Examples of suitable titanium-containing compounds include, but are not limited to, titanium zinc titanate, lanthanum titanate, titanium tetramides, titanium tetramercaptides, titanium tetrabutoxide, titanium tetramethoxides, titanium tetraethoxide, titanium tetrapropoxide, titanium tetrachloride, titanium trichloride, titanium bromides, and combinations of two or more thereof.

Similarly, examples of suitable zirconium-containing compounds include, but are not limited to, zirconium acetate, zirconium formate, zirconium chloride, zirconium bromide, zirconium butoxide, zirconium tert-butoxide, zirconium chloride, zirconium citrate, zirconium ethoxide, zirconium methoxide, zirconium propoxide, and combinations of two or more thereof.

Suitable molybdenum-containing compounds include, but are not limited to, molybdenum(III) chloride, molybdenum (II) acetate, molybdenum(IV) chloride, molybdenum(V) chloride, molybdenum(VI) fluoride, molybdenum(VI) oxychloride, molybdenum(IV) sulfide, sodium molybdate, potassium molybdate, ammonium heptamolybdate(VI), ammonium phosphomolybdate(VI), ammonium dimolybdate(VI), ammonium tetrathiomolybdate(VI), or combinations of two or more thereof.

Examples of suitable germanium-containing compounds include, but are not limited to, germanium chloride, germanium bromide, germanium ethoxide, germanium fluoride, germanium iodide, germanium methoxide, and combinations of any two or more thereof. Examples of suitable indium-containing compounds include, but are not limited to indium acetate, indium bromide, indium chloride, indium fluoride, indium iodide, indium nitrate, indium phosphide, indium selenide, indium sulfate, and combinations of any two or more thereof. Examples of suitable lanthanum-containing compounds include, but are not limited to, lanthanum acetate, lanthanum carbonate, lanthanum octanoate, lanthanum fluoride, lanthanum chloride, lanthanum bromide, lanthanum iodide, lanthanum nitrate, lanthanum perchlorate, lanthanum sulfate, lanthanum titanate, and combinations of two or more thereof.

A boron-containing compound having a formula of $BR_{3-z}W_z$, $(R'BO)_3$, $BW_z$, $B(OR)_3$, or combinations of two or more thereof can be used in the present invention in which R can be hydrogen, an alkyl radical, an alkenyl radical, an aryl radical, an aryl alkyl radical, alkyl arayl radical, and combinations of two or more thereof in which each radical can have 1 to about 20 carbon atoms, R' can be R, RO, RS, $R_2N$, $R_2P$, $R_3Si$, or combinations of two or more thereof, W can be a halogen, $NO_3$, $NO_2$, $SO_4$, $PO_4$, or combinations of two or more thereof, and z is an integer of 1 to 3. Examples of suitable boron-containing compounds include, but are not limited to boric acid, borane-ammonium complex, boron trichloride, boron phosphate, boron nitride, triethyl borane, trimethyl borane, tripropyl borane, trimethyl borate, triethyl borate, tripropyl borate, trimethyl boroxine, triethyl boroxine, tripropyl boroxine, and combinations of two or more thereof.

Upon the incorporation or impregnation of the promoter precursor compound onto the zeolite or zeolite-binder mixture to produce a promoter precursor-incorporated or -impregnated zeolite, the promoter precursor-incorporated or -impregnated zeolite can be subject to calcination under a condition that can include a temperature in the range of from about 300° C. to about 1000° C., preferably about 350° C. to about 750° C., and most preferably 400° C. to 650° C. under a pressure that accommodates the temperature, generally in the range of from about 1 to about 10 atmospheres (atm), preferably about 1 atm for a period in the range of from about 1 to about 30, preferably about 1 to about 20, and most preferably 1 to 15 hours to produce the composition of the invention.

The composition of the invention then can be, if desired, pretreated with a reducing agent before being used in a process for converting a hydrocarbon to an olefin and an aromatic hydrocarbon. The presently preferred reducing agent is a hydrogen-containing fluid which comprises molecular hydrogen ($H_2$) in the range of from 1 to about 100, preferably about 5 to about 100, and most preferably 10 to 100 volume %. The reduction can be carried out at a temperature, in the range of from about 250° C. to about 800° C. for about 0.1 to about 10 hours preferably about 300° C. to about 700° C. for about 0.5 to about 7 hours, and most preferably 350° C. to 650° C. for 1 to 5 hours.

According to the third embodiment of the present invention, a process useful for converting a hydrocarbon or a hydrocarbon mixture to a mixture rich in olefins and $C_6$ to $C_8$ aromatic hydrocarbons comprises, consists essentially of, or consists of contacting a fluid stream comprising a hydrocarbon or hydrocarbon mixture which can comprise paraffins, olefins, naphthenes, and aromatic compounds with a catalyst composition under a condition sufficient to effect the conversion of a hydrocarbon mixture to a mixture rich in olefins and $C_6$ to $C_8$ aromatic hydrocarbons or to enhance the weight ratio of olefins (ethylene and propylene) to the $C_6$ to $C_8$ aromatic compounds. The fluid stream also comprises a diluent selected from the group consisting of carbon dioxide, nitrogen, helium, carbon monoxide, steam, hydrogen, and combinations of two or more thereof. The presently preferred diluents are nitrogen and carbon dioxide for they are readily available and effective. The catalyst composition can be the same as that disclosed in the first embodiment of the invention and can be produced by the second embodiment of the invention. The weight ratio of the diluent to the hydrocarbon is in the range of from about 0.01:1 to about 10:1, preferably about 0.051 to about 5:1, and most preferably 0.1:1 to about 2:1.

The term "fluid" is used herein to denote gas, liquid, vapor, or combinations thereof. The term "hydrocarbon" is generally referred to, unless otherwise indicated, as one or more hydrocarbons having from about 4 carbon atoms to about 30 carbon atoms, preferably about 5 to about 20 carbon atoms, and most preferably 5 to 16 carbon atoms per molecule. The term "enhanced" refers to an increased weight ratio of olefins to BTX employing the catalyst composition as compared to employing a zeolite such as commercially available ZSM-5 and generally the weight ratio is greater than 1:1, preferably 2:1. Examples of a hydrocarbon include, but are not limited to butane, isobutanes, pentane, isopentane, hexane, isohexane, cyclohexane, heptane, isoheptane, octane, isooctane, nonane, decane, undecane, dodecane, tridecane, tetradecane, pentadecane, hexadecane, butenes, isobutene, pentenes, hexenes, benzene, toluene, ethylbenzene, xylenes, and combinations of any two or more thereof.

Any fluid which contains a hydrocarbon as disclosed above can be used as the feed for the process of this invention. Generally, the fluid feed stream can also contain olefins, naphthenes (cycloalkanes), or some aromatic compounds. Examples of suitable, available fluid feeds include, but are not limited to, gasolines from catalytic oil cracking processes, pyrolysis gasolines from thermal cracking of saturated hydrocarbons, naphthas, gas oils, reformates, and combinations of any two or more thereof. The origin of this fluid feed is not critical. Though particular composition of a feed is not critical, a preferred fluid feed is derived from gasolines which generally contain more paraffins (alkanes) than combined content of olefins and aromatic compounds (if present).

The contacting of a fluid feed stream containing a hydrocarbon with the catalyst composition can be carried out in any technically suitable manner, in a batch or semicontinuous or continuous process, under a condition effective to convert a hydrocarbon to a $C_6$ to $C_8$ aromatic hydrocarbon. Generally, a fluid stream as disclosed above, preferably being in the vaporized state, is introduced into an aromatization reactor having a fixed catalyst bed, or a moving catalyst bed, or a fluidized catalyst bed, or combinations of any two or more thereof by any means known to one skilled in the art such as, for example, pressure, meter pump, and other similar means. Because an aromatization reactor and aromatization are well known to one skilled in the art, the description of which is omitted herein for the interest of brevity. The condition can include an hourly space velocity of the fluid stream in the range of about 0.01 to about 100, preferably about 0.05 to about 50, and most preferably 0.1 to 30 g feed/g catalyst/hour. Generally, the pressure can be in the range of from about 0 to about 1000 psig, preferably about 0 to about 200 psig, and most preferably 0 to 50 psig, and the temperature is about 250 to about 1000° C., preferably about 350 to about 750° C., and most preferably 450 to 650° C.

The process effluent generally contains a light gas fraction comprising hydrogen and methane; a $C_2$–$C_3$ fraction containing ethylene, propylene, ethane, and propane; an intermediate fraction including non-aromatic compounds higher than 3 carbon atoms; and a BTX aromatic hydrocarbons fraction (benzene, toluene, ortho-xylene, meta-xylene and para-xylene). Generally, the effluent can be separated into these principal fractions by any known methods such as, for example, fractionation distillation. Because the separation methods are well known to one skilled in the art, the description of which is omitted herein. The intermediate fraction can be recycled to an aromatization reactor described above, methane, ethane, and propane can be used as fuel gas or as a feed for other reactions such as, for example, in a thermal cracking process to produce ethylene and propylene. The olefins can be recovered and further separated into individual olefins by any method known to one skilled in the art. The individual olefins can then be recovered and marketed. The BTX fraction can be further separated into individual $C_6$ to $C_8$ aromatic hydrocarbon fractions. Alternatively, the BTX fraction can undergo one or more reactions either before or after separation to individual $C_6$ to $C_8$ hydrocarbons so as to increase the content of the most desired BTX aromatic hydrocarbon. Suitable examples of such subsequent $C_6$ to $C_8$ aromatic hydrocarbon conversions are disproportionation of toluene (to form benzene and xylenes), transalkylation of benzene and xylenes (to form toluene), and isomerization of meta-xylene and/or ortho-xylene to para-xylene.

After the catalyst composition has been deactivated by, for example, coke deposition or feed poisons, to an extent that the feed conversion and/or the selectivity to the desired ratios of olefins to BTX have become unsatisfactory, the catalyst composition can be reactivated by any means known to one skilled in the art such as, for example, calcining in air to burn off deposited coke and other carbonaceous materials, such as oligomers or polymers, preferably at a temperature of about 400 to about 650° C. The optimal time periods of the calcining depend generally on the types and amounts of deactivating deposits on the catalyst composition and on the calcination temperatures. These optimal time periods can easily be determined by those possessing ordinary skills in the art and are omitted herein for the interest of brevity.

The following examples are presented to further illustrate this invention and are not to be construed as unduly limiting the scope of the present invention.

EXAMPLE I

This example illustrates the preparation of catalyst composition of the invention.

A zeolite HZSM-5 obtained from UCI (United Catalysts, Inc., Louisville, Ky.) having a product designation of T-4480 (obtained as a 1/16 inch extrudate) was used either as catalyst (catalyst A) or in the preparation of the catalyst composition of the invention.

T-4480 zeolite (20 g) was impregnated with a solution containing 9.41 g of triethylphosphate and 15 ml of hexane. The impregnation took about one hour at 25° C. The phosphate-impregnated zeolite was then heated to dryness on a hot plate followed by calcination first at 120° C. for 3 hours and then 550° C. for 3 hours in a muffle furnace to produce 21.6 g of P-promoted zeolite (catalyst B) containing 8 weight % phosphorus by calculation.

In other preparation, T-4480 zeolite (50 g; 37413-42-2) was mixed with 500 ml of 6N HCl to form a mixture. The mixture was stirred at 85° C. for 3 hours followed by washing with a running tap water for 30 minutes, filtered and dried for 3 hours at 120° C. The dried zeolite was then calcined at 530° C. for 3 hours to produce 35.9 g of an acid-leached (AL) zeolite (catalyst C).

Still in another run, 24 g of T-4480 was mixed with 240 ml of 6N HCl followed by heating at 85° C. for 3 hours with stirring. Thereafter, an acid-leached (AL) zeolite was produced. This procedure was repeated and another AL zeolite (catalyst D) was produced. These two batches of AL zeolite were pooled to produce 34.2 g of second AL zeolite.

Further in another run, 10 g of the second AL zeolite was impregnated with a solution containing 1.41 g of triethylphosphate and 10 g of hexane, using the procedure described above for producing P-promoted zeolite, to produce 10.2 g of acid-leached, P-promoted (AL-P) zeolite (catalyst E) containing 2.4 weight % phosphorus by calculation.

A zeolite ZSM-5 obtained from CU Chemie Uetikon AG, Uetikon, Switzerland having a product designate of Zeocat PZ 2/50H (obtained as powder) was used in the preparation of other catalyst compositions of the invention. Fourteen g of the zeolite was well mixed with 15 g of colloidal silica Ludox AS-40 (obtained from DuPont, Wilmington, Del.) in a beaker to make a paste. The paste was dried at 125° C. in an oven for 3 hours. The dried silica-bound zeolite was then subject to calcining at 520° C. for 3 hours to produce a calcined silica-bound zeolite containing 30 weight % silicon oxide by calculation. The zeolite was then crushed to produce particle forms having 10 to 20 mesh (catalyst F) (U.S. standard mesh).

In a separate run, 10 g of the silica-bound zeolite was impregnated with a solution containing 1.41 g of triethylphosphate and 10 g of hexane. Following the procedure described above, a P-promoted, silica-bound zeolite (total 10.2 g) was produced. The P-promoted, silica-bound zeolite (catalyst G) contained 2.4 weight % phosphorus by calculation.

Also in a separate run, 28 g of Zeocat zeolite PZ 2/50H was mixed with 0.99 g of zinc titanate ($ZnTiO_3$) to form a mixture. The mixture was then mixed with 30 g of colloidal silica Ludox AS-40 to form a paste which was then dried, calcined, and crushed as described immediately above to produce a Zn-promoted, silica-bound zeolite (catalyst H) (41.0 g) containing 1.0 weight % Zn and 30 weight % silicon oxide.

A portion (10 g) of the Zn-promoted, silica-bound zeolite was impregnated with 1.41 g of triethylphosphate and 10 g of hexane, following the procedure described above to produce 10.2 g of P, Zn-promoted, silica-bound zeolite (catalyst I) containing 2.4 weight % phosphorus.

Still in a separate run, a solution containing 5.40 g zinc nitrate ($Zn(NO_3)_2.6H_2O$), 2.25 g boric acid ($H_3BO_3$), and 42.35 g of water was first prepared. An aliquot (8 g) of the solution was added to an acid-leached (AL) T-4480 (catalyst C) (10.0 g) to impregnate the acid-leached T-4480 by incipient wetness method. Following drying the resultant Zn/B-impregnated, AL T-4480 in the air at 125° C. for 16 hours, the dried, Zn/B-impregnated, AL T-4480 was steamed at 650° C. for 6 hours to produce 10.26 g of steamed Zn/B, AL T-4480 which contained 1.851 weight % Zn and 0.614 weight % B by elemental analysis. Five batches of this product were made. Similarly, 17 more batches of the steam Zn/B, AL T-4480 were further produced by this method, except that the starting AL T-4480 was 125 g in 5 batches, 150 g in 6 batches, and 166 g in 6 batches with other reagents proportionately increased to the scaled-up AL T-4480 quantities. All products were then pooled. A portion (250 g) of the pooled product was further steamed in a steam reactor at 650° C. for 8 hours in the presence of following helium (540 ml/min) to produce 159.56 g of AL/Zn/B, steamed zeolite (catalyst J) product which contained 1.851 weight % Zn and 0.614 weight % B. Further in a separate run, 10 g of the above-described Zn-promoted, silicon oxide-containing zeolite (catalyst H) was impregnated with a solution containing 0.72 g of ferric nitrate ($Fe(NO_3)_3.9H_2O$) and 15 g of water (about 2 hours at 25° C.) followed by drying at calcining as described above for producing catalyst C to produce an iron-promoted zeolite. The iron-promoted zeolite (5 g) was then steamed at 650° C. as described above to produce 5 g of steamed, Fe-promoted zeolite (catalyst K) containing 1 weight % Zn and 1 weight % Fe.

EXAMPLE II

This example illustrates the use of the catalyst compositions described in Example I as catalysts in the conversion of hydrocarbons to olefins and BTX.

A quartz reactor tube (inner diameter 1 centimeter; length 60 centimeter) was filled with a 20 centimeter bottom layer of Alundum® alumina (inert, low surface area alumina), 4.4 grams of one of the catalysts in the middle 20 centimeter of the tube, and a 20 centimeter top layer of Alundum® alumina. The liquid feed was a gasoline obtained from Phillips Petroleum Company, Bartlesville, Okla., and contained hydrocarbons shown in Table I. The liquid feed shown in Table I is summarized as: 38.7 weight percent (%) lights ($C_5$s and $C_6$s); 1.3% benzene; 5.4% toluene; 8.1% $C_8$ aromatics; 38.9% nonaromatics in BTX boiling range; and 25.9% heavies ($C_8$+). The feed was introduced into the reactor at a rate of 12 ml/hour (8.95 g/hour). The nitrogen co-feed was introduced into the reactor at a rate shown in Table II. The reaction temperature was 600° C. The reactor effluent was cooled and separated into a gaseous phase and a liquid phase by passing through a wet ice trap for liquid product collection and then through a wet test meter for gas volume measurement. The liquid was weighed hourly and analyzed on a Hewlett-Packard 5890 gas chromatograph equipped with a fused silica column (DB-1). The gas was sampled hourly after the ice trap and analyzed on a Hewlett-Packard 5890 gas chromatograph using a HP-PLOT/$Al_2O_3$ column. The gas was also analyzed for hydrogen content on a Carle gas chromatograph using hydrocarbon trap followed by a 13× molecular sieve column. Both phases were analyzed by gas chromatographs at intervals of about 1 hour. About 2 hours after the feed was started, reactor effluent was again sampled and analyzed by gas chromatography for olefins and BTX content. The results of the runs at about 6 hours were shown in Table II below which illustrates the production of olefins and BTX from the Table I feed and individual catalyst compositions produced in Example I.

TABLE I

Hydrocarbon Analysis of Catalytically Cracked Gasoline

| | n-paraffins | Isoparaffins | Aromatics | Naphthenes | Olefins | Total |
|---|---|---|---|---|---|---|
| $C_1$ | 0.000 | 0.000 | 0.000 | 0.000 | 0.000 | 0.000 |
| $C_2$ | 0.000 | 0.000 | 0.000 | 0.000 | 0.000 | 0.000 |
| $C_3$ | 0.000 | 0.000 | 0.000 | 0.000 | 0.000 | 0.000 |
| $C_4$ | 0.000 | 0.000 | 0.000 | 0.000 | 0.018 | 0.018 |
| $C_5$ | 1.292 | 8.147 | 0.000 | 0.000 | 10.741 | 20.348 |
| $C_6$ | 0.749 | 7.164 | 1.266 | 1.972 | 7.135 | 18.287 |
| $C_7$ | 0.740 | 4.576 | 5.354 | 2.746 | 6.483 | 19.899 |
| $C_8$ | 0.760 | 3.234 | 8.120 | 2.531 | 0.830 | 15.475 |
| $C_9$ | 0.187 | 2.070 | 8.187 | 0.708 | 0.125 | 11.278 |
| $C_{10}$ | 0.163 | 1.193 | 5.155 | 0.072 | 0.048 | 6.631 |
| $C_{11}$ | 0.153 | 0.307 | 3.606 | 0.191 | 0.000 | 4.257 |
| $C_{12}$ | 0.115 | 0.974 | 0.768 | 0.088 | 0.000 | 1.946 |
| $C_{13}$ | 0.048 | 0.000 | 0.000 | 0.000 | 0.000 | 0.048 |
| $C_{14}$ | 0.000 | 0.000 | 0.000 | 0.000 | 0.000 | 0.000 |
| Total | 4.208 | 27.664 | 32.457 | 8.478 | 23.381 | 98.188 |
| | | | | | Total $C_{15}$+ | 0.108 |
| | | | | | Total Unknowns: | 1.704 |

TABLE II

Olefins and BTX Production (weight percent in product)

| Catalyst | WHSV $CO_2$ | WHSV $N_2$ | Product yield (wt %) $C_2^=$ | $C_3^=$ | BTX | Total |
|---|---|---|---|---|---|---|
| A(T4480) | 0 | 0 | 6.4 | 6.8 | 41.5 | 54.7 |
| A(T4480) | 0 | 2 | 14.0 | 15.5 | 32.8 | 62.3 |
| A(T4480)+ | 0 | 1 | 10.1 | 7.6 | 46.2 | 63.9 |
| B(T4480 + P) | 0 | 0 | 7.8 | 7.3 | 41.9 | 57.2 |
| B(T4480 + P) | 0 | 2 | 15.1 | 15.5 | 31.7 | 62.3 |
| C(T4480 + AL) | 0 | 0 | 5.7 | 3.9 | 47.6 | 57.2 |
| D(T4480 + AL) | 0 | 2 | 13.8 | 10.5 | 40.7 | 65.0 |
| E(T4480 + AL + P) | 0 | 0 | 9.7 | 11.1 | 35.2 | 56.0 |
| E(T4480 + AL + P) | 0 | 2 | 14.7 | 19.4 | 25.4 | 59.5 |
| F(PZ2/50H + $SiO_2$) | 0 | 0 | 7.1 | 6.0 | 45.7 | 58.7 |
| G(PZ2/50H + $SiO_2$ + P) | 0 | 2 | 15.0 | 18.5 | 27.3 | 60.7 |
| H(PZ2/50H + $ZnTiO_3$ + SiO2) | 0 | 0 | 5.4 | 5.2 | 51.3 | 60.9 |
| I(PZ2/50H + $ZnTiO_3$+ $SiO_2$ + P) | 0 | 2 | 8.9 | 10.6 | 48.6 | 68.3 |
| A(T-4480) | 0.5 | 0 | 7.8 | 6.6 | 43.7 | 58.1 |
| A(T-4480) | 2.0 | 0 | 11.4 | 10.5 | 38.9 | 60.8 |
| J(T-4480 + AL + $ZnB_2O_x$ + Stm) | 0 | 0 | 8.1 | 12.6 | 39.0 | 59.7 |
| J(T-4480 + AL + $ZnB_2O_x$ + Stm) | 1.6 | 0 | 8.5 | 12.7 | 44.0 | 65.2 |
| K(PZ2/50H + $ZnTiO_3$ + $SiO_2$ + Fe + Stm) | 1.6 | 0 | 7.5 | 14.2 | 40.2 | 61.9 |

T4480: ZSM-5 catalyst with $Al_2O_3$ (30 weight %) as binder; PZ2/50H: ZSM-5 powder; AL: acid leaching; $SiO_2$: silica binder; P: phosphate promoter; WHSV: weight hourly space velocity; and the weight hourly velocity of gasoline was about 2 g per hour per g catalyst except the run indicated by "+".

The results presented in Table II demonstrate that each run which the feed contained both gasoline and either nitrogen or carbon dioxide produced significantly more BTX and olefins than the run in which nitrogen was absent from the gasoline feed. The invention catalysts (B, C, D, E, F, G, H, I, J, and K) and the invention process (gasoline feed comprising $N_2$ or $CO_2$) also significantly increased the ratio of produced olefins to BTX, i.e., increased the production of olefins.

The results shown in the above examples clearly demonstrate that the present invention is well adapted to carry out the objects and attain the ends and advantages mentioned as well as those inherent therein. While modifications may be made by those skilled in the art, such modifications are encompassed within the spirit of the present invention as defined by the disclosure and the claims.

That which is claimed is:

1. An aromatization process comprising contacting a fluid which comprises a hydrocarbon and a diluent with a catalyst composition under a condition sufficient to effect the conversion of said hydrocarbon to an olefin and a $C_6$ to $C_8$ aromatic hydrocarbon wherein said catalyst composition comprises a zeolite and an activity promoter which is zinc titanate or borate or a mixture of zinc titanate and iron; said hydrocarbon is selected from the group consisting of butane, isobutanes, pentane, isopentane, hexane, isohexane, cyclohexane, heptane, isoheptane, octane, isooctane, nonane, decane, undecane, dodecane, tridecane, tetradecane, pentadecane, hexadecane, and combinations of two or more thereof; the ratio of the weight hourly space velocity of said diluent to the weight hourly space velocity of said hydrocarbon is in the range of from about 1:1 to about 1:2; and said diluent is selected from the group consisting of nitrogen, carbon dioxide, and the combination thereof.

2. A process according to claim 1 wherein said fluid comprises gasolines from catalytic oil cracking processes, pyrolysis gasolines from thermal cracking of saturated hydrocarbons, naphthas, gas oils, reformates, and combinations of two or more thereof.

3. A process according to claim 1 wherein said catalyst composition contains the activity promoter in the range of from about 0.01 to about 10 weight % based on the catalyst composition.

4. A process according to claim 3 wherein the weight of said activity promoter is present in said catalyst composition in the range of from 0.1 to 5 weight %.

5. A process according to claim 3 wherein said zeolite is ZSM-5.

6. A process according to claim 1 wherein said diluent is nitrogen.

7. A process according to claim 1 wherein said diluent is carbon dioxide.

8. A process according to claim 1 wherein said zeolite is prepared by acid-leaching a zeolite.

9. A process according to claim 1 wherein said zeolite is ZSM-5.

10. An aromatization process comprising contacting gasoline with a catalyst composition comprising ZSM-5 zeolite and an activity promoter which is zinc titanate or zinc borate or a mixture of zinc titanate and iron under a condition sufficient to effect the conversion of said gasoline to an olefin and a $C_6$ to $C_8$ aromatic hydrocarbon wherein said gasoline comprises a diluent selected from the group consisting of nitrogen, carbon dioxide, and combinations thereof; the ratio of the weight hourly space velocity of said diluent to the weight hourly space velocity of said gasoline is in the range of from about 1:2 to about 1:1; and said condition comprises a weight hourly space velocity of said fluid in the range of about 0.01 g/g catalyst/hour to about 100 g/g catalyst/hour, a pressure in the range of about 0 psig to about 200 psig, and a temperature in the range of about 250° C. to about 1,000° C.

11. A process according to claim 10 wherein said catalyst composition contains the activity promoter in the range of from about 0.01 to about 10 weight % based on the catalyst composition.

12. A process according to claim 10 wherein said zeolite is prepared by acid-leaching a zeolite.

13. An aromatization process for enhancing the weight ratio of olefins to $C_6$–$C_8$ aromatic hydrocarbons in the product stream in a process for converting a hydrocarbon mixture to said olefins and said $C_6$–$C_8$ aromatic hydrocarbons comprising contacting said hydrocarbon mixture with a catalyst composition comprising ZSM-5 zeolite and an activity promoter which is zinc titanate or zinc borate or a mixture of zinc titanate and iron wherein said hydrocarbon mixture comprises a diluent selected from the group consisting of nitrogen, carbon dioxide, and the combination thereof and hydrocarbons having at least 4 carbon atoms; said hydrocarbon is selected from the group consisting of butane, isobutanes, pentane, isopentane, hexane, isohexane, cyclohexane, heptane, isoheptane, octane, isooctane, nonane, decane, undecane, dodecane, tridecane, tetradecane, pentadecane, hexadecane, and combinations of two or more thereof; the ratio of the weight hourly space velocity of said diluent to the weight hourly space velocity of said hydrocarbon is in the range of from about 1:1 to about 1:2;

said condition comprises a weight hourly space velocity of said fluid in the range of about 0.01 g/g catalyst/hour to about 100 g/g catalyst/hour, a pressure in the range of about 0 psig to about 200 psig, and a temperature in the range of about 250° C. to about 1,000° C.

14. A process according to claim 13 wherein said hydrocarbon mixture comprises gasolines from catalytic oil cracking processes, pyrolysis gasolines, naphthas, gas oils, reformates, and combinations of any two or more thereof.

15. A process according to claim 14 wherein said hydrocarbon mixture is gasoline.

16. A process according to claim 15 wherein said diluent is nitrogen.

17. A process according to claim 15 wherein said diluent is carbon dioxide.

* * * * *